United States Patent [19]

MacLeod et al.

[11] Patent Number: 4,875,318

[45] Date of Patent: Oct. 24, 1989

[54] PLASTIC BUILDING PRODUCT

[75] Inventors: Richard J. MacLeod, Milford; Charles E. Schiedegger, Metamora, both of Mich.

[73] Assignee: Tapco Products Company, Inc., Detroit, Mich.

[21] Appl. No.: 192,237

[22] Filed: May 10, 1988

[51] Int. Cl.[4] ..... E06B 1/04

[52] U.S. Cl. ..... 52/211; 52/302

[58] Field of Search ..... 52/58, 200, 208, 211, 52/212, 302, 303; 98/32, 37, 121.1

[56] References Cited

U.S. PATENT DOCUMENTS

| | | | |
|---|---|---|---|
| 2,752,844 | 7/1956 | Simblest | 98/121.1 |
| 3,103,710 | 4/1961 | Fredrickson | 52/211 |
| 3,500,600 | 3/1970 | Bagley | 52/211 |
| 4,389,824 | 5/1983 | Anderson | 52/211 |
| 4,407,100 | 10/1983 | Huelsekopf | 52/212 |

FOREIGN PATENT DOCUMENTS

| | | | |
|---|---|---|---|
| 2149494 | 9/1984 | United Kingdom | 98/37 |

*Primary Examiner*—Henry E. Raduazo
*Assistant Examiner*—Jerrold D. Johnson
*Attorney, Agent, or Firm*—Barnes, Kisselle, Raisch, Choate, Whittemore & Hulbert

[57] ABSTRACT

A plastic building product for placement on the wall of a building to provide a louver or window wherein siding abuts the product the product comprises a plastic body having a peripheral wall circumscribing the louver or window, an integral flange extending laterally from the wall for fastening the body to the wall of a building, and a movable flange memebr telescoped over the peripheral wall of the body. The flange member includes a laterally extending flange adapted to overlie portions of abutting siding or the like. The flange member and the peripheral wall include interengaging portions for selectively positioning the flange member at predetermined distances which respect to the flange on the body to accommodate siding of varying thickness.

21 Claims, 4 Drawing Sheets

PLASTIC BUILDING PRODUCT

This invention relates to plastic building products for attachment to the wall of a building having siding or the like such as louvers or windows.

BACKGROUND AND SUMMARY OF THE INVENTION

It has heretofore been suggested that one piece plastic louvers or windows can be provided by vacuum forming plastic so that a peripheral wall of the product circumscribes the louver or window and a laterally extending flange serves as a means for attachment to the wall of the building. It is common to use a J-channel in abutment with such a product to overlie the free edges of siding that abut the product. It has also been suggested that an integral channel be provided for receiving the siding.

Among the objectives of the present invention are to provide a plastic building product of similar construction which will accommodate siding of varying thicknesses.

In accordance with the invention, a plastic building product for placement on the wall of a building to provide a louver or window wherein siding abuts the product comprising a plastic body having a peripheral wall circumscribing the louver or window, an integral flange extending laterally from the wall for fastening the body to the wall of a building, and a movable flange member telescoped over the peripheral wall of the body and including a laterally extending flange adapted to overlie portions of abutting siding or the like. The flange member and the peripheral wall include interengaging means for selectively positioning the flange member at predetermined distances with respect to the flange on the body to accommodate siding of varying thickness.

DESCRIPTION

Figure 8:
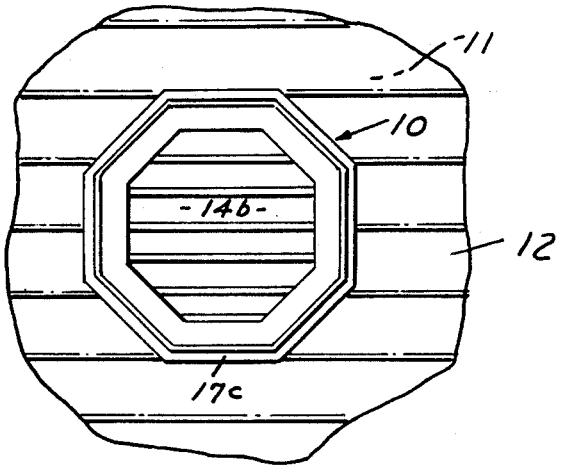
FIG. 8 is a fragmentary elevational view of the wall of a building embodying the invention.
Figure 9:
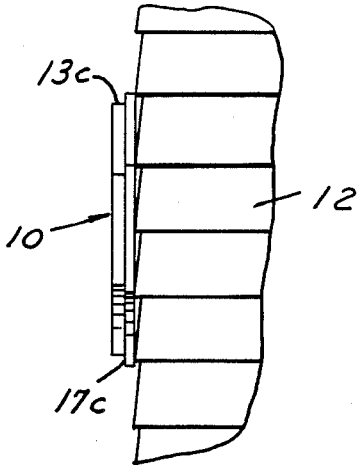
FIG. 9 is a fragmentary side elevational view of the building.
Figure 10:
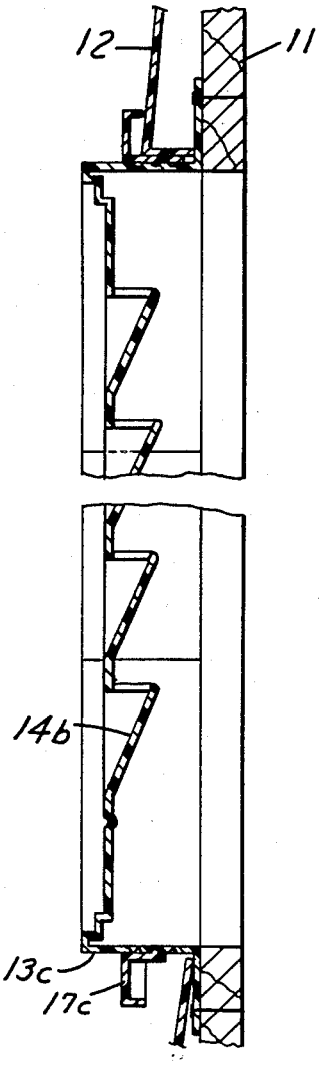
FIG. 10 is a fragmentary sectional view of a further modified form of the invention.
Figure 11:
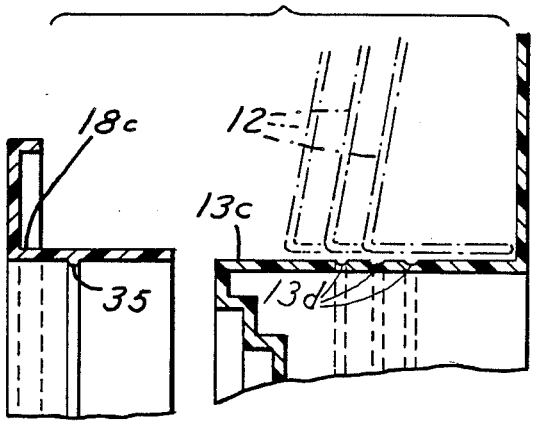
FIG. 11 is a fragmentary exploded sectional view of a portion of the building product shown in FIG. 10.

In accordance with the invention, the plastic building product 10 embodying the invention is adapted to be mounted in a wall 11 having siding 12 of aluminum, plastic or the like (FIG. 8). Referring to FIGS. 1–4, the body 10 includes a continuous peripheral wall 13 that extends axially and circumscribes the louver or window, herein shown as a louver 14, which is integral with the body 10. The body of the product 10 further includes a peripheral flange 15 which abuts the building wall 11 for attachment as by nails or screws 16.

In accordance with the invention, the plastic building product further includes an annular flange member 17 that has an internal configuration corresponding to the external configuration of the peripheral wall 13. As shown in the drawings, the wall 13 is, herein shown as circular, but may be non-circular or other configuration, as presently described. The member 17 includes a continuous axial wall 18 that telescopes over the wall 13 and an integral flange 19 having a lip 20 adapted to engage the siding 12. Interengaging means are provided on the inner surface 21 of the wall 18 of the flange member 17 for engagement with the external surface 22 of the wall 13 to selectively position the flange member 17 in predetermined spaced relationships with respect to the flange 16 in order to accommodate siding of various axial thickness as shown at 12*a* and 12*b* in FIG. 4. The interengaging means is herein shown as tooth 23 on the inner surface of the wall 18 and a plurality of circumferentially spaced teeth in the form of complementary recesses or grooves 24, 25, 26 on wall 13 adapted to selectively engaged by the rib 23.

A tooth 23 is preferably provided at circumferentially spaced points along the wall, herein shown as four in number. Similarly, an equal number of sets of recesses 24, 25, 26 are provided on wall 13. Teeth 23 and recesses 24, 25, 26 are provided and they have nonsymmetrical cross sections which are unsymmetrical cross sections such that when the flange member 18 is moved axially inwardly it causes the teeth 23 to successively engage the teeth 24, 25 or 26 until the flange member 18 abuts the siding.

In practice, the flange member 17 may be shipped apart from body 10. Alternatively, the flange member 17 is applied to the body 10 with teeth at 45° to recesses 24, 25 and 26 so that the teeth and recesses are not engaged. When delivered to the job site, the body 10 is applied to the wall and the siding is then applied. After the siding has been applied, the flange is rotated relative to the body 10 with the teeth 23 oriented to engage the recesses 24. The flange member 17 is then moved axially inwardly to engage the teeth 24, 25 or 26 until the flange member 17 engages the siding. When the teeth 23 are in engagement with one of the ribs of teeth 24, 25, 26, the wall 18 of the retaining member 17 is in flush engagement with wall 13 of body 10.

In order to facilitate application, body 10 is provided with indicia 27 in the form of the integral word "TOP" to indicate the proper orientation of the circular body 10 on the wall 11. In addition indicia 28 in the form of integral lines are provided to indicate the horizontal line. In application to a wall, the indicia 28 can be aligned with a horizontal chalk line to insure proper orientation of the non-circular body 10.

Figure 1:
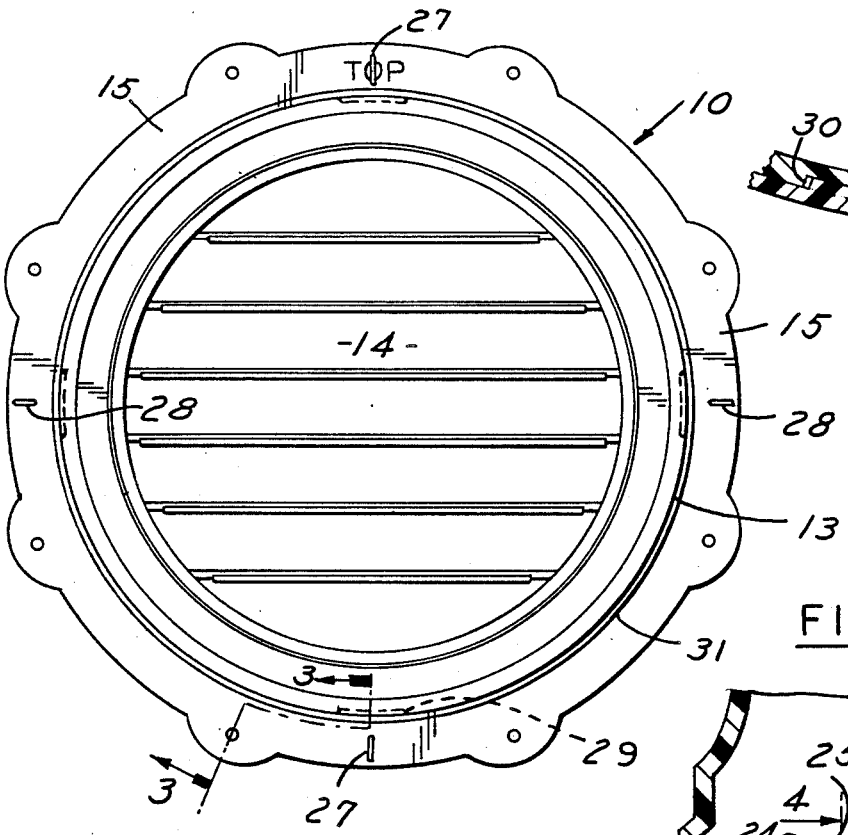
FIG. 1 is a plan view of a plastic building product embodying the invention.
Figure 4:
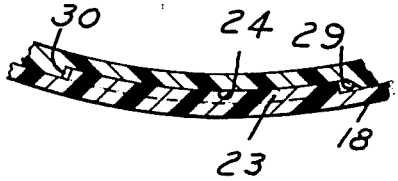
FIG. 4 is a fragmentary sectional view on an enlarged scale taken along the line 4—4 in FIG. 3.

Further, in accordance with the invention, the teeth 23 and recesses 24, 25, 26 are arcuate having generally a radius having a center about the center of body 10 (FIG. 4). In addition, each recess 24, 25, 26 has an inclined surface 29 at one end to facilitate engagement of tooth 23 with a recess when the flange member 18 is rotated. In addition, each recess has its other end formed with a radial surface 30 forming an abutment for limiting the rotation and properly align the tooth 23 with recesses 24, 25, 26.

Figure 3:
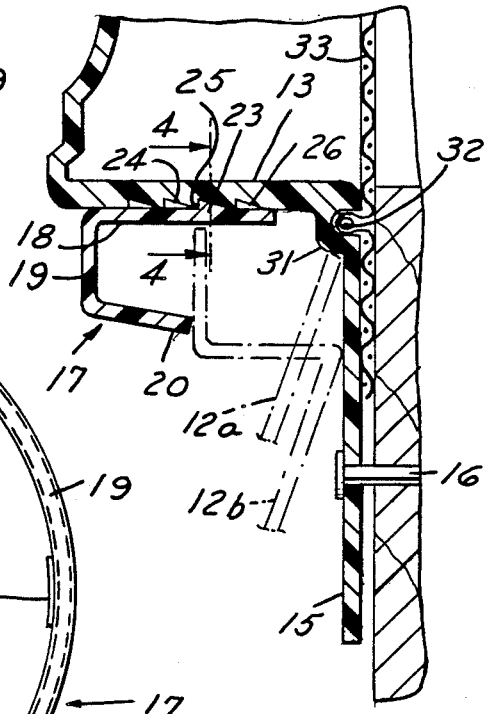
FIG. 3 is a fragmentary sectional view on an enlarged scale taken along the line 3—3 in FIG. 1.
Figure 2:
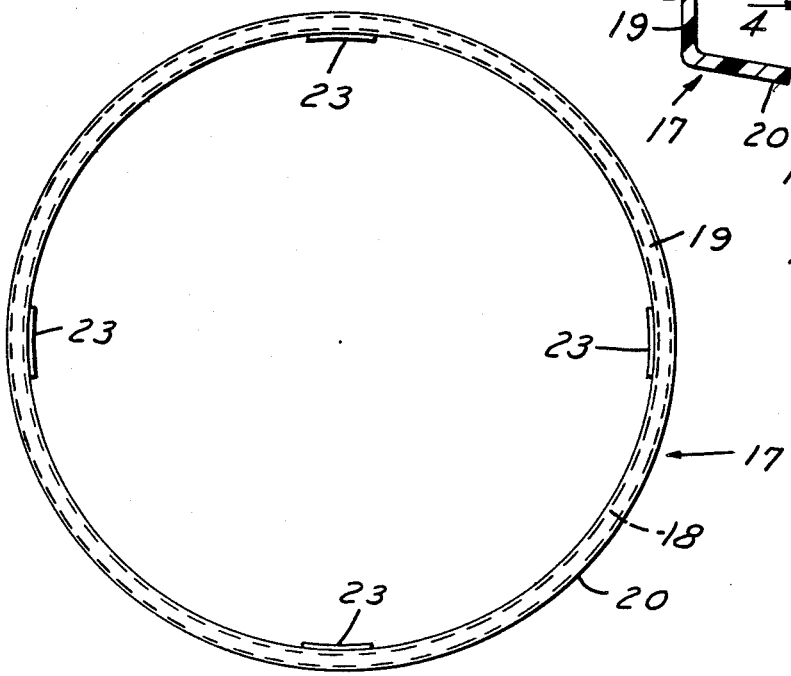
FIG. 2 is a plan view of the retaining flange of the product.

As further shown in FIG. 3, body 10 is formed with an integral annular shoulder 31 which forms an abutment to prevent the siding from moving radially inwardly sufficiently to preclude the movement of the wall 18 to an extent to prevent the flange member 17 from moving into contact with the siding. The shoulder 31 is hollow and provides an annular groove 32 for mounting a screen 33 which is deformed into the groove 32 and held in position by a deformable seal thereby holding seam 33 in position behind louver 14.

Figure 5:
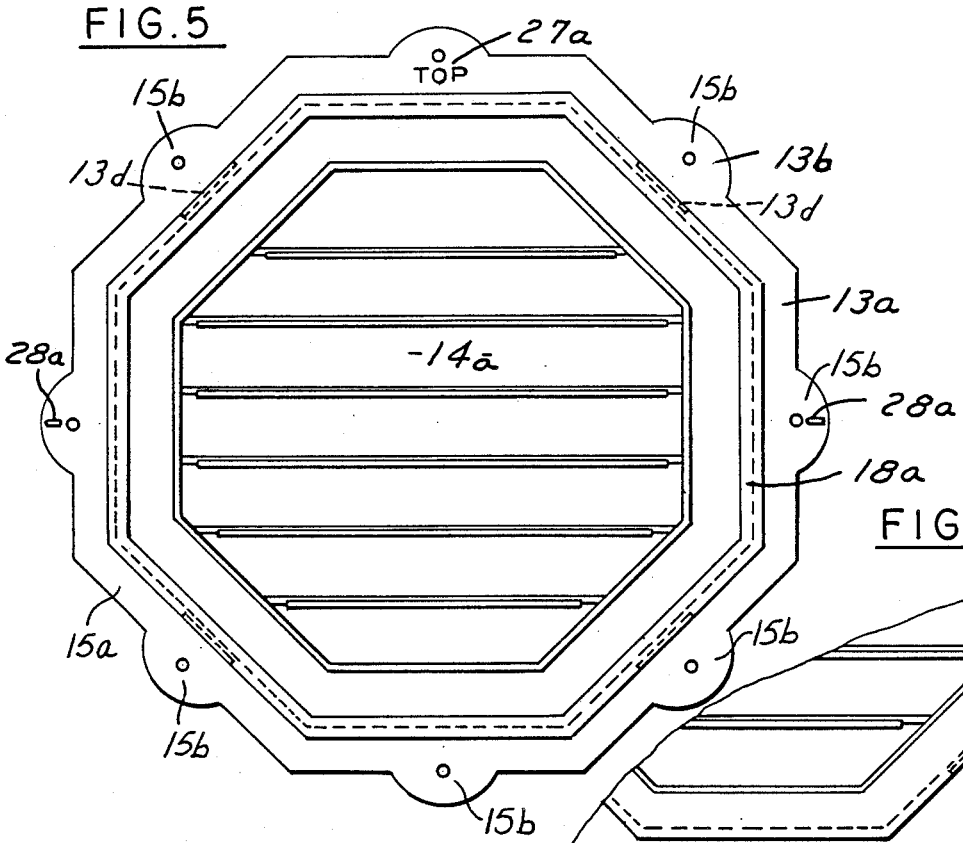
FIG. 5 is a plan view of a modified form of plastic building product.
Figure 7:
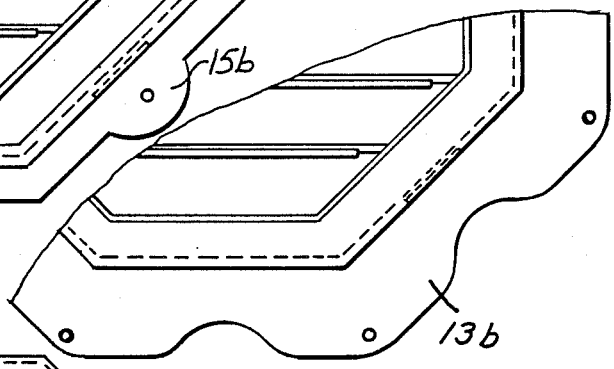
FIG. 7 is a fragmentary rear elevational view of a portion of the product shown in FIGS. 5 and 6.
Figure 6:
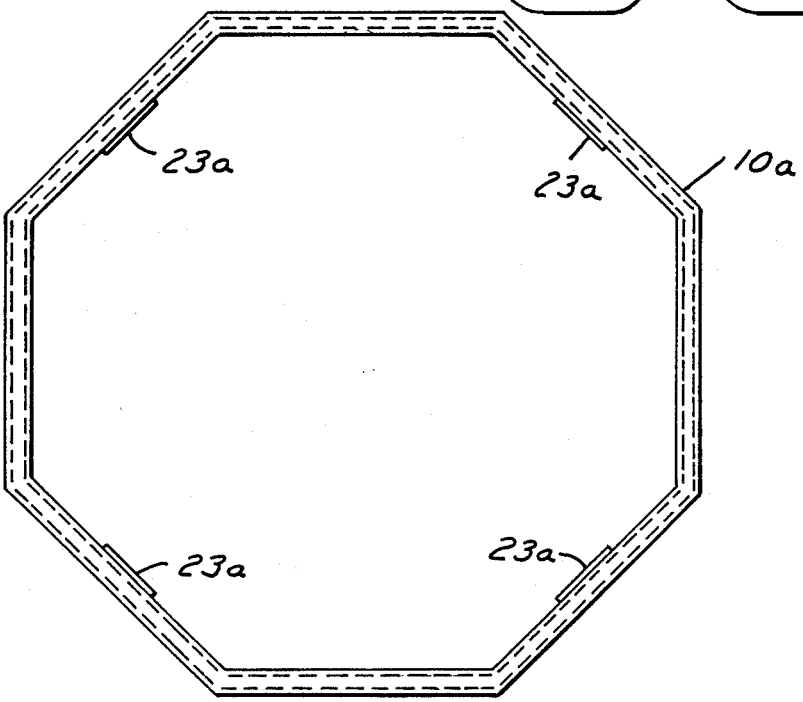
FIG. 6 is a plan view of the building retaining flange of the product shown in FIG. 5.

In the modified form shown in FIGS. 5-7, body **10*a* and retaining member are hexagonal. The various parts are designated with corresponding numbers with the suffix "a". In this form the teeth 23*a* are straight as are the recesses 24*a*, 25*a*, 26*a*. In addition, flange 15*a* is provided with enlarged portions 15*b* to facilitate attachment of body 10*a* to a wall. In the form shown in FIGS. 8-11 interengaging means comprises an annular bead 35 on the continuous inner wall 18*b* of the flange member 17*c* which selectively engages one of a series of axially spaced grooves 13*d* on the external wall 13*c* of body 10*b***.

Figure 12:
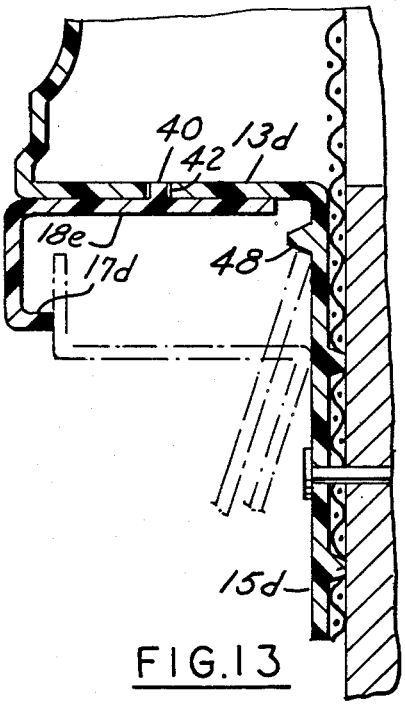
FIG. 12 is a sectional view of the modified building product shown in FIG. 13.
Figure 13:
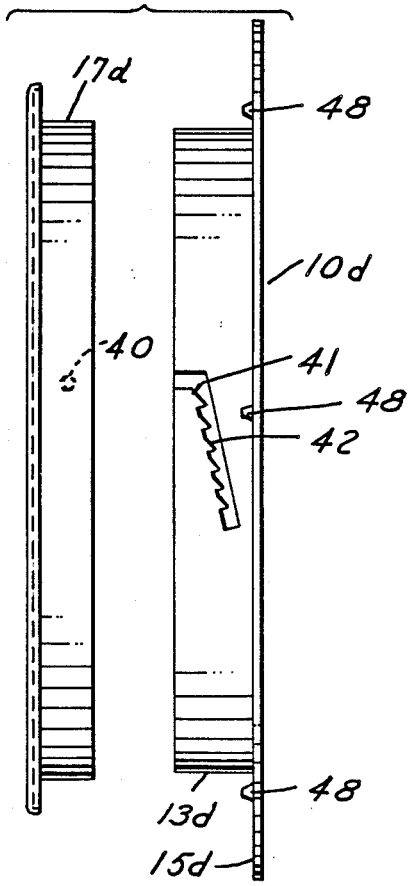
FIG. 13 is an exploded view of a modified building product.

In the form shown in FIGS. 12 and 13, the interengaging means between flange member **17*d* and wall 13*d* comprises a tooth 40 on wall 13*d* which selectively engages teeth 41 on wall 13*d* of flange member 17*d*. The teeth 41 are in a slot 42 and are at an angle such that when the flange member 17*d* is rotated, successive teeth 41** are engaged moving the flange member axially inwardly until it engages the siding.

Figure 14:
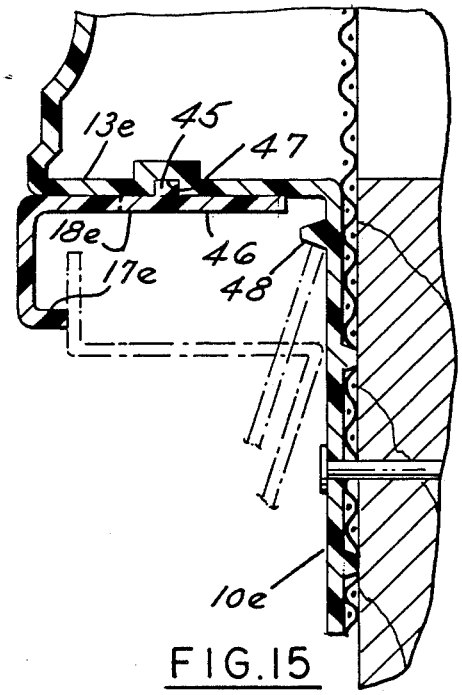
FIG. 14 is a sectional view of the modified building product shown in FIG. 15.
Figure 15:
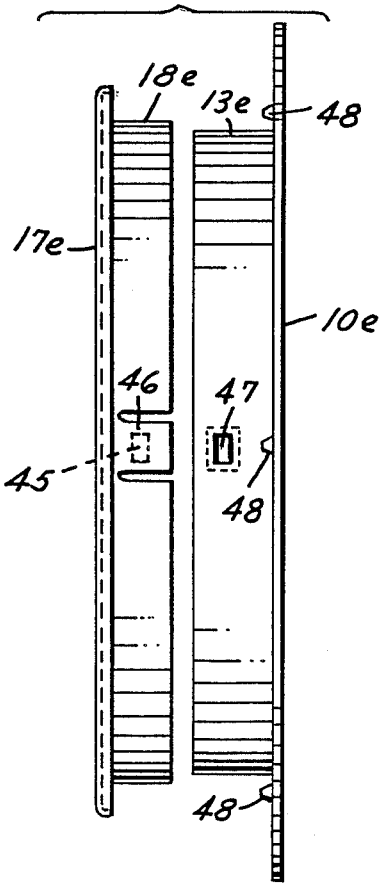
FIG. 15 is an exploded view of another modified building product.

In the form shown in FIGS. 14 and 15, the interengaging means comprises a radial projection 45 on wall **13*e* of the body which engages as opening 46 on an integral spring tab 47 in wall 18*e* of the continuous flange member 17*e***.

In the forms shown in FIGS. 12–15, the projection 48 for limiting the inward movement of siding comprises a solid annular or interrupted axial bead 48.

It can thus be seen that there has been provided a plastic building product for placement in the wall of a building to provide a louver or window wherein siding abuts the product comprising a plastic body having a peripheral wall circumscribing the louver or window, an integral flange extending laterally from the wall for fastening the body to the wall of a building, and a movable flange member telescoped over the peripheral wall of the body and including a laterally extending flange adapted to overlie portions of abutting siding or the like. The flange member and the peripheral wall include interengaging means for selectively positioning the flange member at predetermined distances with respect to the flange on the body to accommodate siding of varying thickness.

We claim:

1. A plastic building product for use on walls of a building having an outer and inner surface to provide a louver or opening wherein siding on said outer surface abuts the product comprising a one-piece plastic body having an integral central portion defining a louver or opening, an integral continuous peripheral wall circumscribing the louver or opening, an integral flange extending laterally from the peripheral wall for fastening the body to said outer surface, and a removable plastic flange member telescoped over the peripheral wall of the body and including a continuous axial wall and an integral laterally extending continuous flange adapted to overlie portions of abutting siding or the like, the flange and the peripheral wall including interengaging means for selectively positioning the flange member at predetermined distances with respect to the flange on the body to accommodate siding of varying thicknesses, said interengaging means being provided at circumferentially spaced positions along said continuous peripheral wall and continuous flange.

2. The plastic building product set forth in claim 1 wherein said interengaging means is provided between an inner surface of the wall of the flange member and an outer surface of the wall on the body.

3. The plastic building product set forth in claim 2 wherein said interengaging means comprises means defining an annular bead on the inner surface of the axial wall of the flange member and a plurality of axially spaced circumferentially extending grooves on the outer surface of the wall of the body.

4. The plastic building product set forth in claim 3 wherein said annular bead is a continuous bead.

5. The plastic building product set forth in claim 2 wherein said interengaging means comprises a tooth on one of said wall of said body and said wall of said flange member and a helical row of teeth on the other of said body and said flange member.

6. The plastic building product set forth in claim 2 wherein said interengaging means comprises spring tabs on one of said body and said flange member and a complementary member on the other of said body and said flange member.

7. The plastic building product set forth in claim 2 wherein said interengaging means comprises a plurality of axially spaced teeth on said body member and a complementary tooth on said flange member.

8. The plastic building product set forth in claim 7 wherein said teeth on said flange member and said body are straight.

9. The plastic building product set forth in claim 7 wherein said axially spaced teeth are in circumferentially spaced sets on said body, and complementary teeth are provided at corresponding equally spaced circumferential positions on said flange member.

10. The plastic building product set forth in claim 9 wherein said teeth have unsymmetrical cross sections.

11. The plastic building product set forth in claim 10 wherein said wall of said flange member and said wall of said body are in flush relationship when said interengaging means are engaged.

12. The plastic building product set forth in claim 11 wherein said wall of said flange member and said body are non circular.

13. The plastic building product set forth in claim 12 wherein said tooth on said flange member and said body are straight.

14. The plastic building product set forth in claim 11 wherein said wall of said flange member and the wall of said body are circular and said teeth are arcuate in a circumferential direction.

15. The plastic building product set forth in claim 14 wherein said teeth on said wall of said body member comprise recesses.

16. The plastic body set forth in claim 15 wherein at least one of said recesses comprises an abutment at one end to serve as a stop to prevent relative rotational movement between said flange member and said body.

17. The plastic building product set forth in claim 16 wherein said recess comprises an inclined portion on the other end of said recess to facilitate rotation of the tooth on said flange member into said recess.

18. A plastic building product for placement in the wall of a building having an outer and inner surface to provide a louver or opening wherein siding of said outer surface abuts the product comprising a plastic body having a peripheral wall circumscribing the louver or opening, an integral flange extending laterally from the wall for fastening the body to said outer surface, a movable flange member telescoped over the peripheral wall of the body and including a laterally extending flange adapted to overlie portions of abutting siding or the like, the flange member and the peripheral wall including interengaging means for selectively positioning the flange member at predetermined distances with respect to the flange on the body to accommodate siding of varying thickness, said interengaging means being provided between the inner surface of the wall of the flange member and the outer surface of the wall on the body, said interengaging means comprising a plurality of axially spaced teeth on said body member and a complementary tooth on said flange member, said axially spaced teeth being in circumferentially spaced sets on said body, and complementary teeth are provided at corresponding equally spaced circumferential positions on said flange member, said teeth having unsymmetrical cross sections, said wall of said flange member and said wall of said body being in flush relationship when said interengaging means are engaged, and said wall of said flange member and the wall of said body being circular and said teeth being arcuate in a circumferential direction.

19. A plastic building product for placement in the wall of a building having an outer and inner surface to provide a louver or opening wherein siding on said outer surface abuts the product comprising a plastic body having a peripheral wall circumscribing the louver or opening, an integral flange extending laterally from the wall for fastening the body to said outer surface, a movable flange member telescoped over the peripheral wall of the body and including a laterally extending flange adapted to overlie portions of abutting siding or the like, the flange member and the peripheral wall including interengaging means for selectively positioning the flange member at predetermined distances with respect to the flange on the body to accommodate siding of varying thickness, said interengaging means being provided between the inner surface of the wall of the flange member and the outer surface of the wall on the body, said interengaging means comprising a plurality of axially spaced teeth on said body member and a complementary tooth on said flange member, said axially spaced teeth being in circumferentially spaced sets on said body, and complementary teeth are provided at corresponding equally spaced circumferential positions on said flange member, said teeth having unsymmetrical cross sections, said wall of said flange member and said wall of said body being in flush relationship when said interengaging means are engaged, and said wall of said flange member and said body being non-circular, said teeth on said wall of said body member comprising recesses, and said teeth on said flange member and said body being straight.

20. A plastic building product for placement in the wall of a building having an outer and inner surface wherein siding on said outer surface abuts the product comprising a one-piece plastic body having an integral central portion, a continuous integral peripheral wall circumscribing the louver or opening, an integral flange extending laterally from the wall for fastening the body to said outer surface, a movable plastic flange member telescoped over the peripheral wall of the body and including a continuous axial wall and an integral laterally extending flange adapted to overlie portions of abutting siding or the like, the flange member and the peripheral wall including interengaging means for selectively positioning the flange member at predetermined distances with respect to the flange on the body to accommodate siding of varying thickness, said interengaging means being provided between the inner surface of the wall of the flange member and the outer surface of the wall on the body, said interengaging means comprising a plurality of axially spaced teeth on said body member and a complementary tooth on said flange member, said axially spaced teeth being in circumferentially spaced sets on said body, and complementary teeth are provided at corresponding equally spaced circumferential positions on said flange member, said teeth having unsymmetrical cross sections, said wall of said flange member and said wall of said body being in flush relationship when said interengaging means are engaged, and said wall of said flange member and the wall of said body being circular and said teeth being arcuate in a circumferential direction.

21. A plastic building product for placement in the wall of a building having an outer and inner surface wherein siding on said outer surface abuts the product comprising a one-piece plastic body having an integral central portion, a continuous integral peripheral wall circumscribing the louver or opening, an integral flange extending laterally from the wall for fastening the body to said outer surface, a movable flange member telescoped over the peripheral wall of the body and including a laterally extending flange adapted to overlie portions of abutting siding or the like, the flange member and the peripheral wall including interengaging means for selectively positioning the flange member at predetermined distances with respect to the flange on the body to accommodate siding of varying thickness, said interengaging means being provided between the inner surface of the wall of the flange member and the outer surface of the wall on the body, said interengaging means comprising a plurality of axially spaced teeth on said body member and a complementary tooth on said flange member, said axially spaced teeth being in circumferentially spaced sets on said body, and complementary teeth are provided at corresponding equally spaced circumferential positions on said flange member, said teeth having unsymmetrical cross sections, said wall of said flange member and said wall of said body being in flush relationship when said interengaging means are engaged, said wall of said flange member and said body being non-circular, said teeth on said wall of said body member comprising recesses, and said teeth on said flange member and said body being straight.

* * * * *